United States Patent [19]

Matte et al.

[11] 4,173,932

[45] Nov. 13, 1979

[54] SAFETY SHUTTER FOR A FUZE

[75] Inventors: Yvanhoe Matte; G. Russel Walker, both of Quebec, Canada

[73] Assignee: The United States of America as represented by the Secretary of the Army, Washington, D.C.

[21] Appl. No.: 846,297

[22] Filed: Jul. 15, 1969

[51] Int. Cl.[2] ..... E42C 15/34

[52] U.S. Cl. ..... 102/254; 89/36 A

[58] Field of Search ..... 102/70, 76–81.2, 102/22, 254; 89/36 A, 16

[56] References Cited

U.S. PATENT DOCUMENTS

| | | | |
|---|---|---|---|
| 1,625,061 | 4/1927 | Troot | 89/36 A X |
| 3,313,236 | 4/1967 | Lohmann | 102/256 |
| 3,380,385 | 4/1968 | Hazelet et al. | 102/254 |

FOREIGN PATENT DOCUMENTS

| | | | |
|---|---|---|---|
| 19360 | of 1913 | United Kingdom | 89/36 A |

*Primary Examiner*—David H. Brown

*Attorney, Agent, or Firm*—Nathan Edelberg; A. Victor Erkkila; Max Yarmovsky

[57] ABSTRACT

A safety shutter for use in ordnance fuzes and the like consisting of two or more metal plates in contact, with each region of contact shaped so that the plates are touching, or nearly touching, only at isolated points or small regions over the confronting faces so that there are six spaces between and intermingled with the areas of contact of the plates such that the broken interfaces between the plates interrupt the transmission of a shock wave capable of inducing spalling from the surface of the shutter which faces the secondary explosive thereby preventing accidental initiation of a propagating detonation. The broken interfaces also absorb the energy of an inadvertently functioned detonator by local crushing and shearing of the metal protuberances on each of the confronting faces of the plates.

7 Claims, 4 Drawing Figures

SAFETY SHUTTER FOR A FUZE

Figure 1:
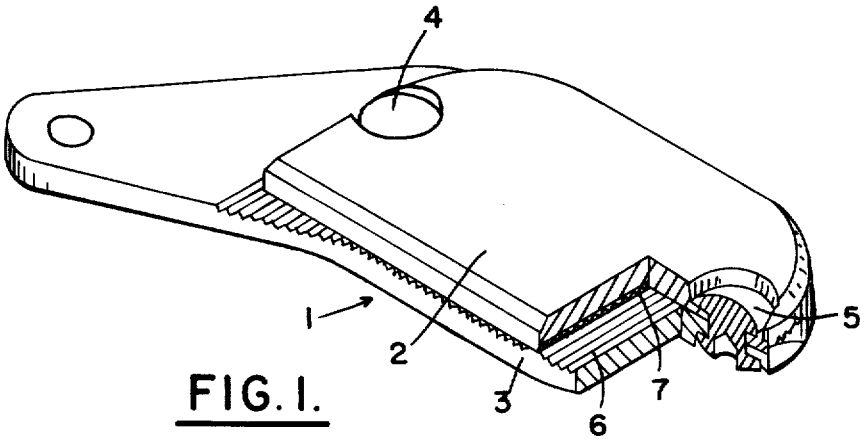

This invention relates to safety shutters for munition devices and more particularly to munition devices containing a high explosive. Such devices should have a very level of safety with respect to the inadvertent detonation of its main filling, which in some instances consists of a rather large explosive charge. The consequences of an unintentional explosion could be a major disaster and it is a matter of great importance to minimize every potential risk of such an eventuality, hence military contrivances almost always have some means of protecting the user against the inadvertent functioning of their initiation device. This initiation device consists, in part, of a detonator (or a sequence of detonators) which transmits energy to and initiates detonation in other explosive compositions which are less sensitive than the primary explosives contained within the detonator.

It is therefore an object of the present invention to improve the efficiency of achieving protection against inadvertent functioning of such means of initiation.

A barrier called a shutter, sometimes called an interrupter, of an appropriate material such as steel, for example, is connected to a suitable mechanical actuating system which maintains the shutter in a position so that it prevents the detonator or sequence of detonators from initiating the less sensitive explosives until such time as the military device nears its target, at which time the actuating system moves the shutter, by a sliding or rotating motion, so that it no longer occupies a position whereby it could interrupt the transfer of detonation from the primary explosive of a detonator to a subsequent explosive composition of the detonation train. These two positions of a shutter are sometimes referred to as the "unarmed" or "safe" position and the "armed" position.

The conventional one-piece shutter of mild steel must have a thickness of about 0.3 inch or more in a typical fuse in order to remain intact and provide adequate safety when subjected to the action of a detonator sufficiently powerful to initiate a secondary explosive across an open gap of about 0.5 inch. The shutter itself must be supported by a mechanical structure sufficiently robust so that neither the shutter nor its supporting structure are driven onto the secondary explosive compositions lest these be initiated to detonation by the impact. This mechanical structure often takes the form of a plate or bulkhead, sometimes called the "platform", whose only opening is a small hole which is covered by the shutter when it is in its "unarmed" position. The only limitations of this conventional design are the excessive spaced occupied by, and the excessive weight of, the shutter and platform.

It is therefore a further object to provide a safety shutter which is light in weight, compact in size and which comprises a minimum of parts.

Figure 2:
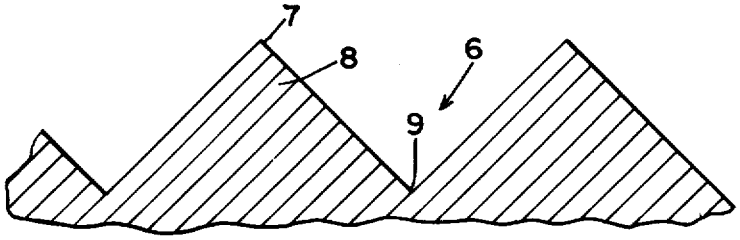
Figure 3:
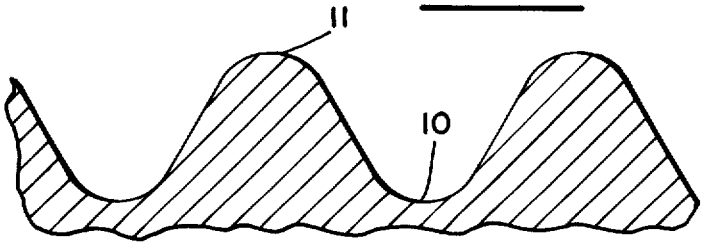
Figure 4:
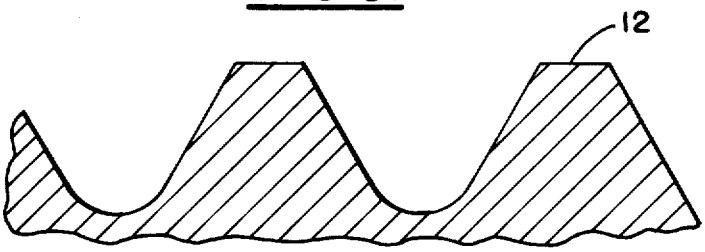

These and other objects, advantages and features will become more apparent from the following description and accompanying drawings, in which:

FIG. 1 is a perspective view, partly broken away, of a safety shutter embodying the invention; and FIGS. 2, 3 and 4 are sectional views illustrating various forms of grooves and ridges which can be incorporated in a safety shutter according to the invention.

Shown in FIG. 1 is an example of a shutter 1 comprising two layers 2 and 3 of mild steel held together by rivets 4 and 5. Grooves 6 are milled or planed into one flat surface of each layer, the two layers being assembled with the groove directions mutually at right angles. A groove depth of about 0.015 inch works well. The groove angle should be about 90° if the peak 7 of each of the ridges 8 defined by the grooves 6 and the bottom 9 of each groove 6 are sharp as shown in FIG. 2; if the bottom of each groove has an appreciable radius, as shown at 10 in FIG. 3, then a smaller angle should be used and also there should be either a corresponding radius on the peaks, as shown at 11 in FIG. 3, or, alternatively, small strips 12 (FIG. 4) of flat virgin plate between each pair of adjacent grooves 6. The grooves may be produced by milling, planing, forging, knurling, broaching, stamping, or in any other manner. Of course, it will be appreciated that grooves constitute only one specific form of rough or interrupted surface which is effective and that the required surface roughness or interruption may take many forms, provided only that each confronting pair of surfaces do not interlock with each other.

The broken interfaces between the layers of safety shutters according to the invention interrupt the transmission of a shock wave capable of inducing spalling from the surface of the shutter which faces the secondary explosive. Spalling of a shutter by the explosive action of a detonator is a matter of concern because the spalled metal pieces, impacting on the adjacent succeeding secondary explosive, may initiate therein a propagating detonation. Therefore, this new composite shutter can safely be made thinner than a conventional solid one with consequent saving of both space and weight.

The inventive shutter has one or more broken interfaces which absorb the energy of an inadvertently functioned detonator by local crushing and shearing of the metal protuberances on each pair of its confronting surfaces. This action of crushing and shearing thereby reduces the quantity of residual energy which the platform must be capable of absorbing, an energy-absorbing feature that is not found in the conventional one-piece shutter.

A shutter according to the invention has no excessively thick angle layer and so it easily acquires a "dish" or saucer shape from the output of a detonator, whereas a conventional solid steel shutter remains rigidly flat. The inventive shutter consequently acts to seal the hole in the platform more effectively than the conventional shutter, thereby achieving greater protection against detonator flame leakage to the nearby secondary explosive.

Again, because of its flexibility and dishing as described above, the inventive shutter applies an impulsive force to the platform more uniformly distributed around the center of action of the detonator, and not, as for a conventional rigid shutter, at a few limited areas whose locations depend upon the mechanical features and dimensional clearances of the mechanism.

We claim:

1. In a munition having a main explosive charge, a detonating charge for exploding said main charge, and a safety shutter between said charges for minimizing the risk of inadvertent explosion of said main charge, said safety shutter being movable from a "safe" to an "armed" position, the improvement comprising, in combination therewith, a pair of thin metal shutter plates fastened together in contact with each other by fastening means passing through aligned holes in said plates, one of said plates being near said detonating charge and the other plate being near said main charge when said safety shutter is in the "safe" position, each of said plates having a plurality of parallel grooves in only one of its faces, said grooves of said first plate facing the grooves of said other plate and running in a direction perpendicular to the direction of the grooves in said other plate to provide substantially only point contacts between said plates;

the other surface of each of said plates being substantially smooth;

one of said plates being larger than the other plate, said larger plate being the arm of said movable shutter, and said larger plate being ungrooved in the area not in contact with said other plate;

whereby upon accidental explosion of said detonating charge when said safety shutter is in the "safe" position, the shock wave energy of said detonating charge is absorbed by crushing deformation and shearing of said grooved plates without spalling of the plate near said main charge, and the detonation of said main charge is thereby prevented.

2. The improvement as claimed in claim 1, wherein the depth of said grooves is about 0.015 inch.

3. The improvement as claimed in claim 1, wherein the bottoms of said grooves and the peaks of said ridges are substantially right-angled.

4. The improvement as claimed in claim 1, wherein the bottoms of said grooves and the peaks of said ridges are rounded.

5. The improvement as claimed in claim 1, wherein the bottoms of said grooves are rounded and the peaks of said ridges are flat.

6. The improvement as claimed in claim 1 wherein said shutter plates are of mild steel.

7. The improvement as claimed in claim 1, wherein said shutter plates are riveted together.

* * * * *